United States Patent [19]

Kacir et al.

[11] 4,006,691

[45] Feb. 8, 1977

[54] TRAIN HOLDING DEVICE

[75] Inventors: Ivan R. Kacir, Highland Heights; Edward T. Manning, Jr., Bay Village; Donald A. Schmieley, Brook Park, all of Ohio

[73] Assignee: McDowell-Wellman Engineering Company, Cleveland, Ohio

[22] Filed: June 11, 1975

[21] Appl. No.: 586,057

[52] U.S. Cl. ..... 104/176; 104/162; 104/252; 213/224

[51] Int. Cl.[2] ..... B61B 9/00; B61J 3/06; B61K 7/16

[58] Field of Search ..... 104/162, 176, 249, 252, 104/254, 256; 213/224; 214/52 R, 52 B, 52 C, 53, 55

[56] References Cited

UNITED STATES PATENTS

| | | | |
|---|---|---|---|
| 2,017,392 | 10/1935 | Blake | 104/256 |
| 3,942,451 | 3/1976 | Modliszewski | 104/176 |
| R27,300 | 2/1972 | Ludwig | 104/176 |

*Primary Examiner*—Robert J. Spar
*Assistant Examiner*—Randolph A. Reese
*Attorney, Agent, or Firm*—McNenny, Pearne, Gordon, Gail, Dickinson & Schiller

[57] ABSTRACT

A train position control arm adapted for use in handling cars of a unit train in a movable train positioner and in a stationary train holder. The arm is proportioned to engage a car coupler from a zone limited to the area immediately above the coupler so that a symmetrical pair of such arms may be simultaneously employed at the same location on a mating pair of couplers. A coupler engaging head of the arm includes elements for engaging and disengaging a coupler under full compression or buff loading. In a train holder apparatus, the arm is pivotally supported on a horizontal axis spaced from the tracks and at substantially the same height as a car coupler. A stationary base supporting the arm includes shock absorbing apparatus adapted to resist impact forces on the arm along a line coincident with the pivot axis.

10 Claims, 6 Drawing Figures

Fig. 5
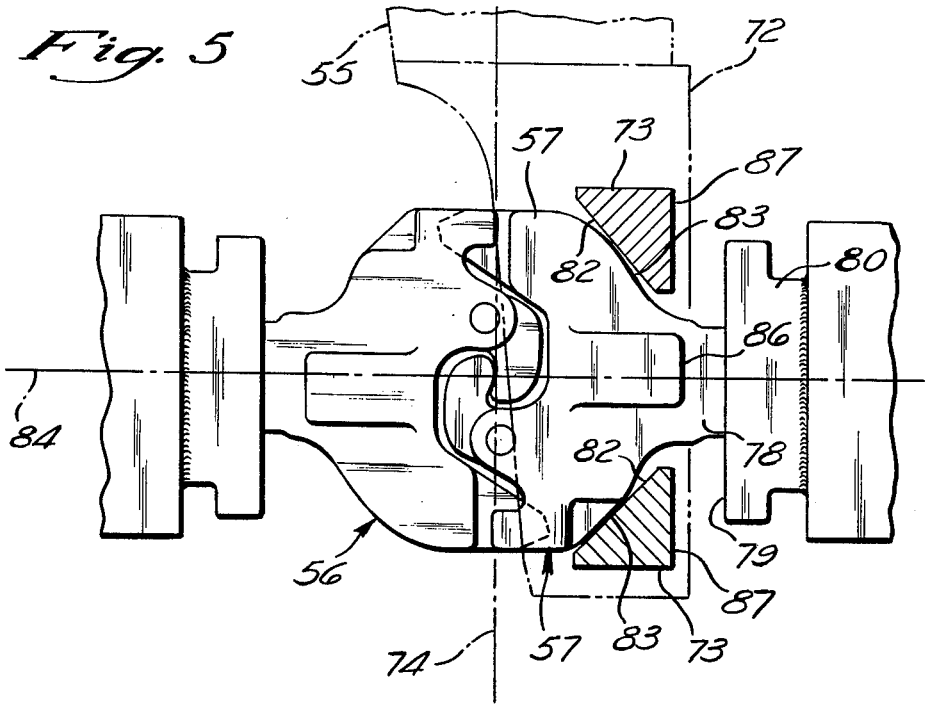
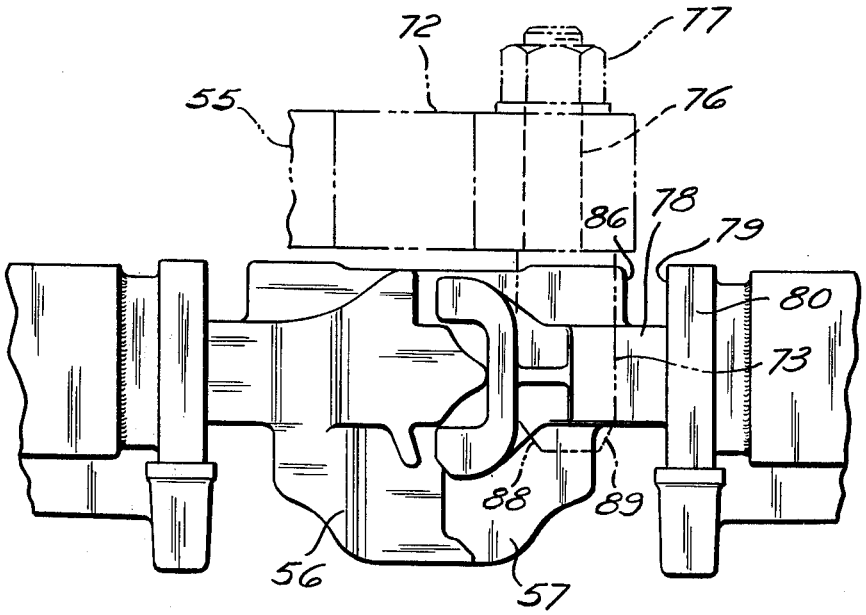
Fig. 6

TRAIN HOLDING DEVICE

BACKGROUND OF THE INVENTION

The invention relates to train handling apparatus and, more specifically, to apparatus for indexing a train through a work station one or more cars at a time while the cars remain coupled.

Unit trains, usually comprising 100 or more cars of identical size, are recognized as efficient carriers of bulk raw materials, such as coal, iron ore, limestone, and liquid or dry chemicals. Of major concern in systems employing unit trains are the speed and reliability of equipment for handling such trains at work areas wherein they are loaded or unloaded. U.S. Pat. No. Re. 27,300, for example, discloses railroad car handling apparatus which is adapted to automatically index a unit train through a rotary car dumper or other equipment for filling or emptying a car or a limited number of cars at a time. Various techniques for holding a train at a given position have been proposed or used in addition to wheel chocks disclosed in the aforementioned patent. Wheel chocks, while providing adequate service in most installations, are inherently limited in their capacity for holding a train when the car with which they are engaged is empty, since the car, when driven by a heavy load, has a tendency to roll up over the chocks. Moreover, extremely high coupler loading on a chocked car may cause structural damage to the suspension area of the car's undercarriage.

Apparatus for stopping or otherwise locating a railroad car are shown in U.S. Pat. Nos. 2,017,392 to Blake and 3,220,576 to Cheek, showing stop arms pivotal in a vertical plane. U.S. Pat. Nos. 2,945,606 to Musschoot et al. and 3,799,064 to Kikuchi et al. are representative of devices for engaging a coupler which are retractable and/or operated from under the trackway. Such devices are typically limited to use with uncoupled car ends.

SUMMARY OF THE INVENTION

The invention provides a train position control arm adapted to engage a car by its coupler and which has certain features which are advantageous both in stationary train holding apparatus and with a traveling carriage of a train positioner. In accordance with one aspect of the invention, a position control arm is provided with a coupler engaging head having a structure which avoids interference problems upon engagement and disengagement when a coupler is under a compressive or buff load. The disclosed arm head structure is dimensioned to fit over the coupler shank area between the coupler and striker plate, even when the coupler is compressed against the striker plate under dynamic or unusual conditions, so that the arm may be readily introduced between these elements and later withdrawn therefrom without being pinched.

Additionally, the preferred arm head is proportioned to cooperate with a symmetrical arm and head assembly on the same coupler set so that both a traveling car positioner and a stationary train holder may be arranged in overlapping relation at a common station. This feature keeps the overall length and spacing of train handling equipment to a minimum, thereby conserving yard space and permitting the use of this equipment in a wide variety of existing yard conditions where grade or space considerations preclude or complicate the use of other known systems.

Another important aspect of the invention involves a train holding arm for maintaining a train in a fixed position while loading or unloading operations are being conducted on one or more of the cars. The train holding arm as provided by the invention is fixed on a foundation suitable for resisting coupler transmitted impact forces encountered in typical train handling and indexing operations. The train holding arm is pivotal from a position laterally displaced from the path of the train into a position of engagement with the coupler and striker plate area of a car positioned beside it to temporarily maintain this car and the remaining cars connected to it in a fixed position. The coupling mechanism, of which the coupler and striker plate are components, in conventional railroad cars is designed to safely withstand the impact loads developed in a train and transmitted by the couplers when it is stopped and started. The holding arm of the invention, therefore, advantageously operates on a point of a car which is most adapted to withstand severe shock loading without incurring structural damage. Moreover, since the holding force applied at the coupling is vertically near the center of gravity of the arrested car and in line with the force developed on this car by the cars connected to it, the tendency of the arrested car to jump or otherwise release itself from the holding arm is minimized.

The various position control arms disclosed hereinbelow are privotally mounted about a horizontal axis laterally spaced from the tracks. A portion of a control arm extending transversely to the pivot axis swings through a vertical plane into the space between a pair of coupled cars to lock over a coupler. The pivot axis of the arm is arranged at substantially the same height as a coupler being held so that the resultant forces and force couples on the arm and its related supporting structure are minimized and are readily absorbed. A shock absorber is provided on the support structure of the train holding arm to absorb major impact forces transmitted to the arm by the car being held. Ideally, the shock absorber is arranged to resist such impact forces with a force coincident with the arm pivot axis, to minimize the complexity of the forces on the holding arm and avoid unnecessary force couples.

BRIEF DESCRIPTION OF THE DRAWINGS

FIG. 5 is a plan view of a pair of joined car couplers and coupler engaging pin means of the holder arm constructed in accordance with the invention; and FIG. 6 is a side elevational view of the coupler area illustrated in FIG. 5, showing the corresponding relationship of the coupler engaging pin means and the coupler elements.

DESCRIPTION OF THE PREFERRED EMBODIMENT

Figure 1:
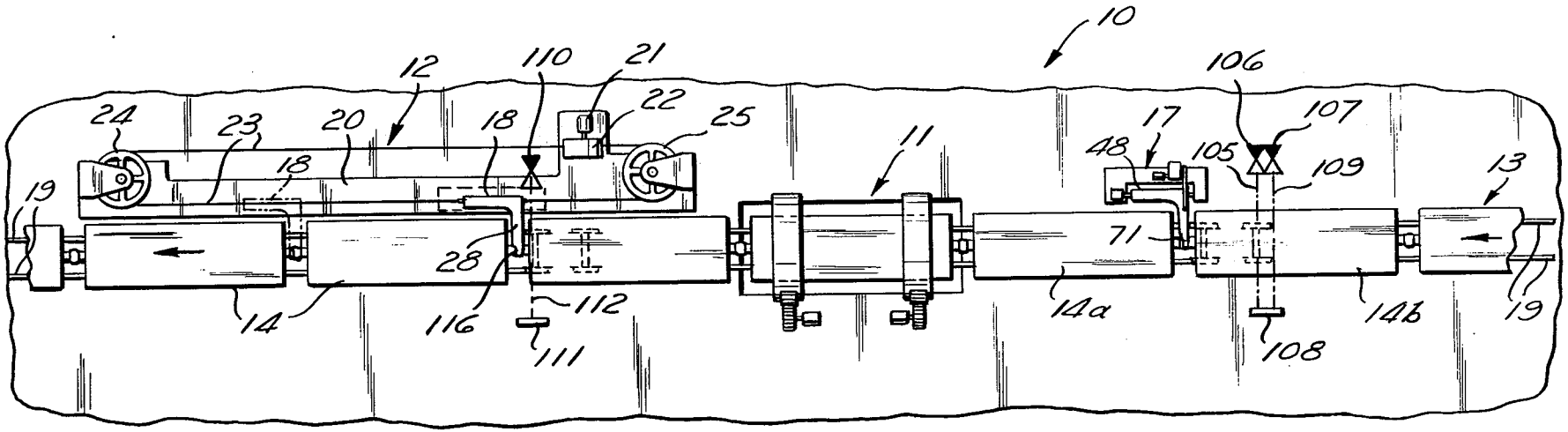
FIG. 1 is a plan view of a work station in which a train positioner and a train holder are spaced from one another at opposite ends of a rotary car dumper.

Referring now to the drawings, and in particular to FIG. 1, a work station indicated generally at 10 includes a car dumper schematically shown at 11 and of the type generally shown, for example, in U.S. Pat. No. 3,209,927 to Ludwig. Car positioner apparatus 12 is disposed adjacent an exit end of the rotary car dumper 11 for pulling a unit train 13 of identical cars 14, one car length at a time, leftwardly through the dumper. The positioner 12 may be of the general type described in U.S. Pat. No. Re. 27,300, referred to above, the disclosure of which is incorporated herein by reference. Train holder apparatus 17 is disposed on the opposite or entrance end of the dumper 11.

The positioner apparatus includes a carriage 18 supported on a guideway 20 for movement parallel to the train tracks, designated 19, through the work area 10. The carriage 18 is driven back and forth on the guideway 20 by a haulage motor and gear reducer 21 rotating a drum 22 in one direction or another to operate a cable 23 reeved through sheaves 24 and 25. Suitable electric controls, including sensing devices discussed below, may be provided for effecting either automatic or manual operation of the haulage motor 21 to cause the carriage 18 and a position control arm 28 to move from its rest position, shown in solid line in FIG. 1, to a forward index position, illustrated in phantom, one car length to the left to cause a corresponding leftward movement of the unit train 13. While an indexing movement of one car length is suggested in FIG. 1 and described hereinbelow, it should be understood that the guideway 20 may be of sufficient length to index a limited fixed number of cars, for instance two or three, with each stroke of the carriage 18. Incremental movement and stoppage of the train 13 by the positioner apparatus 12 permits a car or cars to be unloaded without uncoupling by inversion in the rotary dumper 11 in a known manner. The train holder apparatus 17 serves to maintain the train 13 in a stationary position during the dumping operation and while the positioner arm 28 and carriage 18 are returning from their forward index position.

Figure 3:
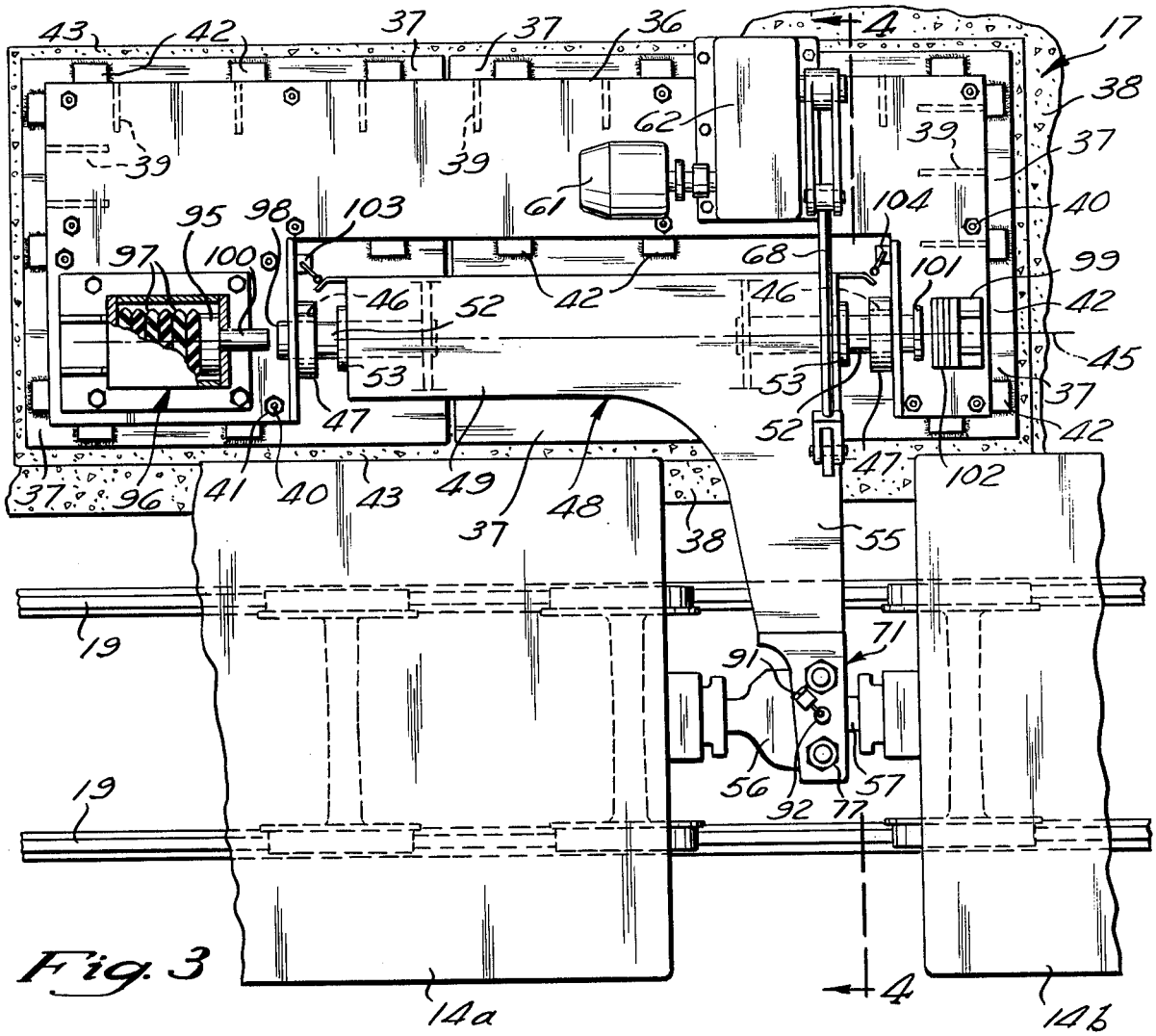
FIG. 3 is a plan view, on an enlarged scale, of a train holder with its arm in an extended coupler engaging position.
Figure 4:
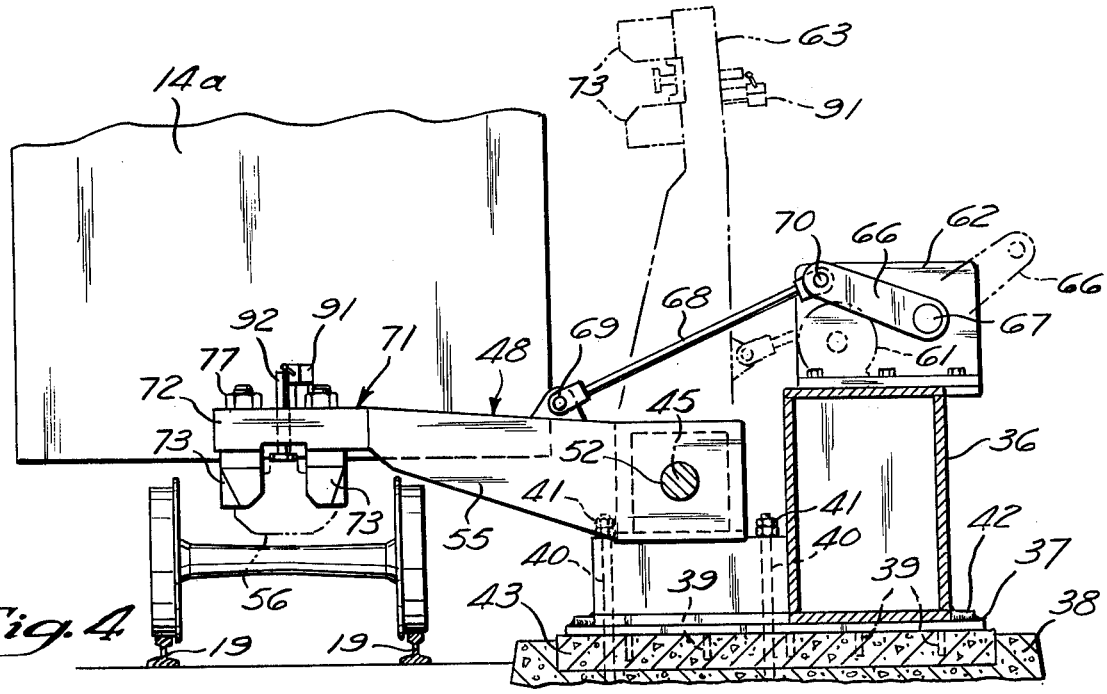
FIG. 4 is an end view of the train holder taken along the line 4—4 indicated in FIG. 3.

Describing the train holding apparatus 17 in greater detail, reference is made to FIGS. 3 and 4. The apparatus 17 includes a base 36, preferably constructed as a structural steel weldment. The weldment 36 is supported on steel mounting plates 37, which in turn are rigidly fixed and embedded in a foundation 38 of concrete or other suitable material extending below grade in an excavation of appropriate size. Each mounting plate 37 includes vertical shear plates 39 welded at spaced locations on its underside surface along its edges. The shear plates 39 and underside surface of the plates 37 are embedded in a pocket of grout 43 or suitable settable cement, poured or otherwise worked under the plates through suitable holes (not shown) after the plates have been leveled and temporarily or otherwise held on the foundation 38. The base 36 is fixed in relation to the mounting plates 37 by a plurality of anchor bolts 40. The bolts 40 are embedded in the foundation 38 and extend vertically upwardly through the mounting plates 37 and the base 36 to provide threaded stud portions on which are tightened pairs of jammed nuts 41. The base 36 is horizontally located and fixed in position on the plates 37 by a plurality of chock bars 42 welded to both the plate and base along their peripheries.

The base 36 extends longitudinally along the tracks 19 and provides support for a pair of axially aligned sleeve bearings 46 carried in respective spaced bearing housings 47 bolted or otherwise fixed to the base. The bearings 46 support an L-shaped train position control arm 48 for pivotal movement about a horizontal axis 45 parallel to the tracks 19. A first portion 49 of the arm 48 extends axially between the bearings 46 and includes a pair of axially aligned, cylindrical pivot pins 52. The pivot pins 52 include radial flanges 53 bolted or otherwise fixed to the arm portion 49. The pins 52 are journaled in the bearings 46 for rotation with the arm 48, while axial clearance between the flanges 53 and bearing housings 47 allows for limited trackwise or axial movement of the arm relative to the base 36 for reasons discussed below.

A second arm portion 55 extends transversely to the first arm portion 49 and the axis 45 defined by the pivot bearings 46. The second arm portion 55 is dimensioned to swing in a vertical plane between the ends of a pair of coupled cars 14*a* and 14*b*. As illustrated in FIG. 4, the pivot axis 45 of the arm 48 is at substantially the same vertical height as that of an adjacent pair of car couplers 56 and 57.

Power actuator means in the form of an electric motor 61 and gear reducer 62 is provided to pivotally move the control arm 48 between a retracted position (shown in phantom at 63 in FIG. 4) out of the path of the cars 14 and the coupler engaging position shown in full line in FIG. 4. The motor 61 and reducer 62 are conveniently bolted to the base 36. A crank arm 66 fixed to an output shaft 67 of the reducer 62 is suitable connected to the arm portion 55 by an intermediate link 68. Universal pin joints 69 and 70 on the ends of the link 68 permit limited axial movement of the arm 48 relative to the base 36.

A coupler engaging head 71 at a distal end of the transverse arm portion 55 includes a mounting block 72 and a pair of depending, spaced pins or lugs 73. The block 72, indicated in phantom in FIG. 5, is proportioned such that when engaged with a coupler 57 it is disposed solely to a respective side of a transverse centerline 74 through the joined pair of couplers 56 and 57. The pins 73 which depend vertically downwardly from the block 72 when the arm portion 55 is in its horizontal or coupler engaging position, are bolted to the block 72 by integral, threaded studs 76 extending through the block and tightened with nuts 77. The pins 73 are forged of high strength steel, and the integral studs 76 are keyed in their respective bores of the block 72 to prevent relative rotation. The pins 73 are of sufficient length to depend from the block 72 to a point below the shank, designated 78, of the respective coupler 57 (FIG. 6).

As revealed particularly in FIGS. 4 and 5, the spacing between the pins 73 permits them to straddle the coupler shank 78 in a zone between the head of the coupler 57 and a vertical surface 79 of a striker plate 80 associated with the coupler 57. FIG. 5 illustrates the typical plan profile of a conventional bulb-shaped coupler head, a type F coupling being illustrated. The pins 73 are generally triangular in cross section (see FIG. 5) with a face 82, describing the hypotenuse of the cross section, being adapted to engage the coupler surfaces 83 flaring generally outwardly or laterally with respect to the longitudinal coupler axis, designated 84, in a direction towards the mating coupling 56. It is to be understood that one of the couplers 56, 57 of each coupler pair is provided with a rotary shank to permit overturning of coupled cars in the dumper 11.

In a conventional manner, the coupler head 57 and the shank 78 are mounted for relative movement in the striker casting 80. The axial or trackwise components of such movement are resisted by cushioning means within the draft gear, and are limited in compression by contact between a coupler horn surface 86 and the vertical striker plate surface 79. In accordance with an important aspect of the invention, the pins 73 are dimensioned such that with the angle or hypotenuse surfaces 82 in contact with the adjacent rearward surfaces 83 of the coupler head 57, rearward surfaces 87 of the pins 73 are spaced from a transverse plane defined by the rear surface 86 of the coupler horn. Thus, with the coupler 57 under compression and the horn surface 86 in contact with the striker surface 79, there remains trackwise or axial clearance for the pins 73 sufficient to avoid the risk of the pins' being pinched between these elements, thereby allowing ready insertion and removal of the pins therebetween. Beveled surfaces 88 and 89 on the distal end of the pins 73 (FIG. 6) allow the pins to self-center over the coupler shank 78 between the coupler head 57 and striker plate surface 79. The triangular cross sectional configuration of the pins 73 is preferred, since it provides a relatively large amount of stock in the confined area between the coupler head 57 and the striker casting 80.

Referring to FIGS. 3 and 4, means for sensing engagement of the coupler engaging head 71 and the coupler 57 is provided in the form of a limit switch 91 suitably mounted on the upper side of the mounting block 72. A sensing rod 92 extends through a hole in the mounting block 72 into the zone between the pins 73 and is spring-biased towards the distal ends of these pins. As the arm portion 55 swings over a coupler, the sensing rod 92 is displaced relative to the block 72 upwardly into engagement with the limit switch 91 to indicate that the coupler head 71 has been fully engaged with the associated coupler 57.

As previously indicated, the bearings 46 allow longitudinal or trackwise movement of the postion control arm assembly 48 in either direction. As shown in FIG. 3, a shock absorbing device 96 is rigidly secured to the holder base 36. The shock absorber 96 includes a plurality of shock absorbing or damping pads 97 of elastomeric material, preferably such as that commonly used in rubber-cushioned railroad draft gear. The shock absorbing device 96 is provided with a capacity sufficient to absorb all of the normally expected shock loads developed in the work station by the train's stopping and starting movement produced by the positioner apparatus 12, and in particular, the traveling shock waves developed as a traveling car impacts its preceding stopped car and this preceding car impacts the car ahead of it, etc. As illustrated in the various figures, the indexing motion of the train is leftward, so that the major impact loads on the holder arm assembly are towards the left, i.e., the direction of momentum of the cars. Leftward movement of the arm 48 is restrained by engagement of an end face 98 of the pivot pin 52, with a rod 100 which has its opposite end fixed to a disc 95 in abutting contact with an end one of the pads 97. The pads 97 are arranged to absorb all of the expected energy loads imparted on the arm 48 through a restrained coupler by taking a compression of approximately 3 inches.

A motion damping assembly 99 (FIG. 3) is fixed on the rightward end of the base 36 to damp extraneous motion and rebound action of the arm 48 as it is influenced by movement of the associated coupler 57 and car 14*b*. An enlarged disc 101 is fixed to the rightward end of the adjacent pivot pin 52 for abutting contact with a stack of force damping pads 102 on the assembly 99. The pads are preferably a laminate or other composite of resilient material of elastomeric base having large compressive strength and high damping characteristics. Rightward movement of the arm 48 from the centered position illustrated in FIG. 3 will be limited and damped by contact of the enlarged disc 101 with the adjacent pads 102. Limit switches 103 and 104 carried on the base 36 are arranged to sense extreme displacement of the arm assembly 48 in a leftward or rightward direction, respectively, under static conditions. Such displacement may be encountered with the arm engaged on a coupler and the train improperly positioned or spotted by the positioner 12, or with the existence of an unusual load condition on the train, in which case, the switches 103 and 104 provide means for signaling the required corrective action by the positioner 12 or by manual intervention.

The position control arm 28 of the train's positioner apparatus 12 and its associated coupler head 116 are constructed in the same manner as that described above in connection with the holder apparatus 17 or, alternatively, that illustrated in the aforementioned U.S. Pat. No. Re. 27,300. Similarly, power actuator means like that disclosed above, or that shown in this patent, are provided to pivotally raise and lower the positioner arm 28 through a vertical plane between opposed ends of a coupled pair of cars.

In operation of the positioner and holder apparatus 12 and 17, a unit train 13 of cars 14 of identical lengths is initially positioned in the work area by a locomotive, for example, such that the couplers of the first several cars are properly indexed in confronting relation with the respective arms 28 and 48, as illustrated in FIG. 1. The positioner 12 operates through a cycle in which it reciprocates along the guideway 20 to index the train 13, one car length at a time, through the dumper 11 to permit successive cars to be unloaded in the dumper. At the start of a cycle, the positioner arm 28 is in its lower extended position in engagement with an adjacent coupler, while the holder arm 48 is retracted. The haulage drive motor 21 is actuated and the train 13 is moved through successive acceleration, driving and deceleration modes.

Limit switches (not shown) along the guideway 20 cause a decrease in speed of the positioner carriage 18 near the end of forward travel of the carriage. A pair of sensors 106 and 107 in the form of photoelectric eyes at wheel height sense the position of a car 14 approaching the station of the holder apparatus 17. Light sources immediately adjacent the sensors 106 and 107 emit light beams 105 and 109, which are reflected by a stationary reflector 108 on the opposite side of the tracks. Upon reaching a selected point along the guideway 20, a suitable limit switch causes the haulage drive motor to stop the carriage 18 and train 13. Where one light beam 105 is broken by a car wheel and the other beam 109 is made, the train is assumed to be properly spotted or positioned at the holder 17. Where both beams are made, the train is caused to reverse at slow or creep speed until the leftward or reverse beam 105 is broken. Where both beams are broken, the carriage 18 is driven at creep speed forwardly until the rightward or forward beam 109 is made, thereby indicating that the train is properly positioned adjacent the holder 17. The holding arm 48 is then lowered by actuation of the arm drive motor 61 through suitable electrical control responsive to the proper condition of the sensors 106 and 107. Upon full lowering of the holding arm 48, the limit switch 91 is actuated to produce a signal, indicating that car dumping operations in the dumper 11 are permissible and that the positioner arm 28 may be retracted and the carriage 18 returned.

A photocell sensor 110 traveling with the carriage 18 is arranged to sense the relative position of the lead wheels of a car adjacent the rest position of the positioner 18. A light source associated with the sensor 110 emits a beam 112 over the tracks 19 for reflection by a reflector 111 on the opposite side of the tracks. A limit switch is disposed along the guideway 20 near the rest position of the carriage 18 to slow down and then stop the haulage motor 21 to cause the carriage to come to rest at or near the desired location. The sensor 110 is used in a hunting or position-finding mode such that the carriage 18 is always stopped from movement in one direction, for instance moving forward to the left at creep speed until the beam 112 is made.

With the positioner carriage 18 in the proper location, the arm 28 is lowered. A limit switch is provided on the positioner arm head 105, like the switch 91 on the holder arm, to sense full engagement of the positioner arm 28 with the adjacent coupler. Suitable controls are provided to ensure that at least one of the other of the positioner or holder arms 28 or 48, respectively, is in engagement with a coupler so that the train is always under control of either the positioner 18 or holder 17.

The exact final rest position of a coupler relative to the holder arm 48 will vary, due to variations associated with the stopping position accuracy of the positioner 12 and the physical variations of the cars within manufacturing tolerances. The beveled edges 88 and 89 on the leading ends of the holder pins 73 (FIG. 6) are adapted to guide the pins into proper registration over the shank 38 of a coupler, while the axial float of the arm 48 permitted by axial freedom of the pivot pins 52 in the bearings 46 allows for self-registration of the arm with the final position of the car coupler 57. The shock absorber rod 100 and cushion assembly 99 are spaced relative to the arm pivot pins 52 to provide unrestrained freedom of movement of approximately ¾ inch in both directions for the purpose of self-alignment of the arm 48 with the coupler 57. A cam arrangement on the arm 48 (not shown), such as illustrated in the aforementioned U.S. Pat. No. Re. 27,300, may be provided to return the arm to the centralized position of FIG. 3 when it is retracted.

The pins 73 are bidirectional in their retarding of movement of the train when engaged with a coupler 57. The force tending to move the train or a restrained car forwardly, such as that developed as a traveling wave upon stopping of the positioner carriage 18, is resisted by contact between the holder pin surface 87 and striker plate surface 79. Such forces are cushioned and damped by the described shock absorber 96. Train forces on the coupler 57, tending to move it rearwardly or to the right, are resisted by contact between the pin faces 82 and the coupler 57 itself.

Figure 2:
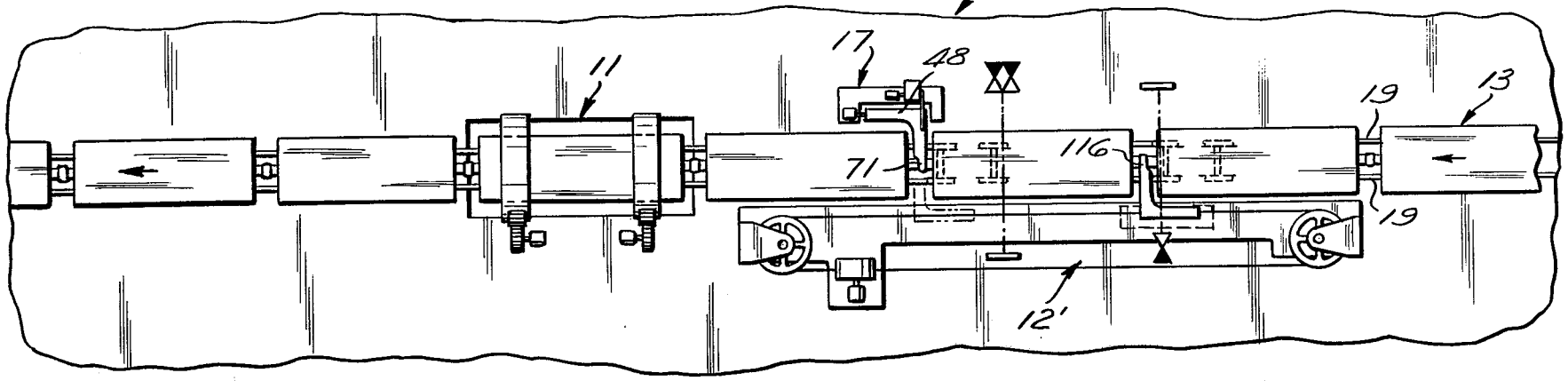
FIG. 2 is a plan view similar to FIG. 1 of a work station in which the train positioner and train holder are arranged at one end of the work station with the stroke of the positioner overlapping the location of the train holder, thereby enabling the positioner and holder to intermittently operate on a mating pair of couplers.

Referring to FIG. 2, a work area 115 is shown in which the holder apparatus 17 and a positioner 12' are arranged at the entrance side of the dumper 11. The positioner 12' and holder 17 are arranged on opposite sides of the tracks 19, with each coupler-engaging head 71 and 116 having a construction such as that shown in FIGS. 5 and 6, but with the positioner 12' having an orientation opposite to that of the holder. In the indexing or forward position of the positioner, shown in phantom in FIG. 2, the positioner and holder are in an overlapping relation so that their respective coupler engaging heads 116 and 71 engage a common set of joined couplers.

This arrangement illustrates the versatility of the disclosed arm structure, which permits operation of symmetrical arms in the same zone so that the train handling equipment does not require extensive track length for its employment, and permits cars to be spotted or positioned accurately in both the holder and positioner stations. This close or overlapping station arrangement thereby avoids positional errors introduced by cars intermediate these handling stations and resulting from accumulated differences in axial length, compression or extension of the draft gear created by surrounding grade, and loaded or unloaded state of the remaining cars. It will be apparent that the holder apparatus 17 may be employed at the exit end of the dumper 11 or other work station.

Although the present invention has been illustrated herein with reference to a particular, presently preferred embodiment thereof, it will be appreciated that it is not restricted to the slavish imitiation of each and every detail set forth herein. Obviously, numerous variations thereof may be made without departing from the scope of the invention as defined in the appended claims.

What is claimed is:

1. Apparatus for handling the cars of a train at a work area, comprising a train positioner station and a train holding station, said train positioner station including a carriage and a guideway for guiding the carriage along a path adjacent and parallel to the tracks of the train, an arm mounted on the carriage and movable from a retracted position out of the path of the train to an extended position, said arm including means for controlling the position of a car when said arm is in its extended position, means to drive the carriage along the guideway with the arm extended to index the train a unit distance equal to one or more car lengths and return the carriage to a rest position with the arm retracted, said holder station including a stationary base, an arm movable in a vertical plane from a retracted position out of the path of the train to an extended position between a pair of coupled cars, said holder arm having a coupler engaging head, said head having means to prevent significant trackwise movement of said train in either direction when it is in engagement with a car coupler, and means responsive to the positioning of a car at the completion of an indexing stroke to initiate extension of the holding arm and engagement of its head with an adjacent coupler.

2. Apparatus as set forth in claim 1, wherein said positioner arm includes car coupler engaging means, said positioner coupler engaging means and said holder coupler engaging head being arranged to simultaneously engage mating car couplers.

3. Apparatus for holding successive cars of a unit train on tracks leading to or from a station, comprising a base immovably mounted above grade on a foundation, pivot means mounted directly on said base and defining a pivot axis parallel to the tracks leading to the station, a pivotal car holding arm having a first portion supported on said pivot means and a second portion extending from the first portion transversely to the pivot axis, said first and second portions being rigidly interconnected and being capable of withstanding normally expected coupler loads without relative distortion therebetween during train handling operations, said second portion having a width limited to permit it to be swung about said axis in a vertical plane between a pair of coupled cars and having a length sufficient to reach a coupler of a car positioned on the tracks adjacent the base, said second portion including at its distal end coupler engaging means adapted to engage and prevent trackwise movement of the coupler of the adjacent car, means for moving the second portion of the arm from a first position lateral of the path of the train to a second position at which said coupler engaging means is adapted to engage the coupler of an adjacent car and maintain it at a desired position relative to said station.

4. Apparatus as set forth in claim 3, including shock absorbing means interposed between said arm and said base, said shock absorbing means being arranged to absorb the normally expected energy transferred to the engaged coupler during train handling operations.

5. Apparatus as set forth in claim 4, wherein said pivot means includes means for permitting trackwise movement of said arm, said shock absorbing means being arranged to dissipate energy during trackwise movement of said arm.

6. Apparatus as set forth in claim 5, wherein said shock absorbing means is arranged to resist trackwise movement of said arm with a force coincident with the pivot axis of said arm.

7. Apparatus as set forth in claim 6, wherein said pivot means is arranged to permit said arm to shift in both axial directions from a centered position whereby said arm is adapted to register itself relative to the final position of the coupler of the adjacent car.

8. Apparatus as set forth in claim 7, including sensing means for determining abnormal static displacement of said arm in either axial direction and being adapted to produce a signal to energize means for adjusting the position of the train towards a desired position.

9. Apparatus as set forth in claim 3, wherein said pivot axis is arranged at substantially the same horizontal plane above grade as the coupler of the adjacent car.

10. Apparatus as set forth in claim 3, wherein said coupler engaging means includes sensing means to produce a signal when said coupler engaging means is in full engagement with the coupler of the adjacent car.

* * * * *